US010053953B2

(12) United States Patent
Go Boncan

(10) Patent No.: US 10,053,953 B2
(45) Date of Patent: Aug. 21, 2018

(54) SYSTEM, APPARATUS AND METHODS FOR BLENDING CEMENT

(71) Applicant: Baker Hughes Incorporated, Houston, TX (US)

(72) Inventor: Virgilio C Go Boncan, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 534 days.

(21) Appl. No.: 14/664,831

(22) Filed: Mar. 21, 2015

(65) Prior Publication Data

US 2016/0271833 A1 Sep. 22, 2016

(51) Int. Cl.

| | |
|---|---|
| ***B28C 5/00*** | (2006.01) |
| ***E21B 33/14*** | (2006.01) |
| ***B28C 7/04*** | (2006.01) |
| ***B28C 7/16*** | (2006.01) |
| ***B28C 5/16*** | (2006.01) |
| ***B01F 7/00*** | (2006.01) |
| ***B01F 7/16*** | (2006.01) |
| ***B01F 7/30*** | (2006.01) |

(52) U.S. Cl.

CPC ..... *E21B 33/14* (2013.01); *B01F 7/0095* (2013.01); *B01F 7/1665* (2013.01); *B01F 7/30* (2013.01); *B28C 5/166* (2013.01); *B28C 7/0418* (2013.01); *B28C 7/16* (2013.01)

(58) Field of Classification Search

CPC .. B01F 7/0095; B01F 7/00958; B01F 7/1665; B01F 7/30; E21B 33/14; B28C 5/166; B28C 7/0418; B28C 7/16

USPC ..... 366/65, 76.4, 83, 190, 194, 27

See application file for complete search history.

(56) References Cited

U.S. PATENT DOCUMENTS

| | | | | |
|---|---|---|---|---|
| 3,559,956 A | | 2/1971 | Gray | |
| 4,176,967 A | | 12/1979 | Brinkmann et al. | |
| 4,416,543 A | | 11/1983 | Brinkmann | |
| 4,478,519 A | * | 10/1984 | Guibert | A21C 1/06 366/139 |
| 4,506,982 A | | 3/1985 | Smithers et al. | |
| 4,548,507 A | * | 10/1985 | Mathis | B28C 9/00 366/156.2 |
| 5,020,916 A | | 6/1991 | Fritsch | |
| 5,249,860 A | | 10/1993 | Buschbom et al. | |
| 5,267,837 A | * | 12/1993 | Mowli | F04C 11/005 417/203 |
| 5,906,779 A | * | 5/1999 | Middleton | B29B 17/0026 264/115 |

(Continued)

FOREIGN PATENT DOCUMENTS

| | | |
|---|---|---|
| CN | 2813084 | 9/2006 |
| CN | 201013841 | 1/2008 |

(Continued)

*Primary Examiner* — Anshu Bhatia

(74) *Attorney, Agent, or Firm* — E. Randall Smith; E. Randall Smith, P.C.

(57) ABSTRACT

A system for blending cement and at least one additive during a blending job to create a cement slurry for use in an underground hydrocarbon well includes a mixing tub, at least first and second blenders and a rotatable platform upon which the blenders are mounted. Each blender includes at least one elongated, rotatable, mixing blade extending into the tub to mix the cement and at the additive(s) to form the cement slurry.

30 Claims, 3 Drawing Sheets

(56) References Cited

U.S. PATENT DOCUMENTS

| | | | | |
|---|---|---|---|---|
| 6,007,233 | A | 12/1999 | Cairns | |
| 6,129,520 | A * | 10/2000 | Cooper | B07B 1/00 241/81 |
| 2009/0133478 | A1 | 5/2009 | Sentmanat | |

FOREIGN PATENT DOCUMENTS

| | | |
|---|---|---|
| CN | 201500524 | 6/2010 |
| CN | 203019531 | 6/2013 |

* cited by examiner

SYSTEM, APPARATUS AND METHODS FOR BLENDING CEMENT

FIELD OF THE INVENTION

The present disclosure relates generally to system, apparatus and method for blending cement, such as cement used in the underground hydrocarbon wells.

BACKGROUND

Various industries involve the mixing of cement and one or more additives to create a cement slurry having desired characteristics. For example, in the hydrocarbon exploration and production arena, cement is used for various cementing work in the underground wells, such as to affix the casing inside the well. Cement additives may be available in a variety of forms, such as powder and liquid. For cement slurry used in hydrocarbon wells, a variety of types of additives may be used, such as to modify the characteristics of the slurry or set cement. Examples of additives are accelerators, retarders, fluid-loss additives, dispersants, extenders, weighting agents, lost circulation additives and special additives designed for specific operating conditions.

In many applications, the cement slurry may be delivered across long distances and/or the slurry and set cement may be subject to high temperatures and pressures. For example, in some wells, Portland cement is used as the base material mixed with silica sand designed to prevent the cement from cracking at high temperatures, and one or more retarders to cause the cement slurry to stay liquid for a desired period of time. The proper proportions and type of additives used in the slurry can significantly affect cement performance. Poor cement performance can lead to substantially increased cost and loss of valuable time and revenue.

Various currently known techniques for blending cement may have one or more drawbacks or limitations. For example, existing "air bulk blending" and similar techniques often require first the loading of cement, followed by additives and then more cement into a mixing tank. High pressure air is blown inside the tank to push the cement up and down and blend the components. At completion of the blending job, the blender is emptied into containers for delivery. This process is not continuous—it requires interruption at the beginning and end of each blending job to load and unload the materials. It also requires on-site material handling personnel. Further, the blending job is limited to the volume capacity of the mixing tank. In some instances, potentially harmful dust may be spread into the ambient air in the work area. Sometimes, the cement and additives may be contaminated by moisture in the air during mixing, experience premature chemical reactions and/or adhere to the tank wall. Often, material segregation occurs in the mixing tank due to the differing specific gravities of the components because they are not continuously stirred and agitated, leading to a non-uniform slurry product. Further, low specific gravity components may float in the air, be carried away in vent lines and lost from the blended slurry.

It should be understood that the above-described features and examples are provided for illustrative purposes only and are not intended to limit the scope or subject matter of the appended claims or those of any related patent application or patent. None of the appended claims or claims of any related application or patent should be limited by the above discussion or construed to address, include or exclude each or any of the cited examples, features and/or disadvantages, merely because of the mention thereof herein.

Accordingly, there exists a need for improved systems, apparatus and methods for blending cement having one or more of the attributes or capabilities described or shown in, or as may be apparent from, the other portions of this patent.

BRIEF SUMMARY OF THE DISCLOSURE

In some embodiments, the present disclosure involves a system for blending cement and at least one additive during a blending job to create a cement slurry for use in an underground hydrocarbon well. The exemplary system includes a mixing tub having an upper end and a lower end and at least one outer wall extending therebetween. The upper end is at least partially open and the lower end is at least substantially closed. At least two inflow ports are formed in the outer wall. Each inflow port is configured to allow the flow of at least one among cement and at least one additive into the mixing tub. At least one discharge port is formed in the mixing tub and configured to allow the discharge of cement slurry from the mixing tub.

In these embodiments, at least first and second adjacent blenders are associated with the mixing tub and configured to mix the cement and at least one additive to form the cement slurry within the mixing tub. Each blender has at least a first elongated, rotatable, mixing blade extending into the mixing tub. The first mixing blade of the first blender is configured to rotate in a direction opposite to the rotational direction of the first mixing blade of the second blender. The exemplary system also includes a platform upon which the blenders are mounted and below which the mixing blades extend. The platform is configured to be positioned proximate to the upper end of the mixing tub and rotatable relative to the mixing tub, whereby rotation of the platform concurrently rotates the blenders mounted thereto.

In various embodiments, the present disclosure involves an internal cement slurry collection system for use in a cement mixing tub for blending cement and at least one additive during a blending job to create a cement slurry for use in an underground hydrocarbon well. The mixing tub includes upper and lower ends and at least one discharge port. The system includes at least one inner discharge tube and at least one outer discharge tube disposed within the mixing tub. The inner discharge tube is positioned concentrically within the outer discharge tube. The inner and outer discharge tubes having adjacent open upper and lower ends. The upper ends of the discharge tubes are positioned in the mixing tub closer to the upper end of the mixing tub as compared to the lower ends of the discharge tubes, while the lower ends of the discharge tubes are positioned in the mixing tub closer to the lower end of the mixing tub. The inner discharge tube is in fluid communication with at least one discharge port of the mixing tub. The discharge tubes are configured to allow cement slurry to flow from the mixing tub into the upper end of the inner discharge tube, through the inner discharge tube and out the mixing tub through at least one discharge port therein.

In these embodiments, each discharge tube has a wall extending between the upper and lower ends thereof and at least one window formed in the wall proximate to the lower end thereof. At least one window of the outer discharge tube is alignable over at least one window of the inner discharge tube. At least one among the inner and outer discharge tubes is selectively movable relative to the other discharge tube to move the respective alignable windows thereof between at least one aligned position and at least one misaligned position. The windows in the aligned position allow the flow of cement slurry therethrough from the mixing tub into the inner discharge tube. The windows in the misaligned position disallow the flow of cement slurry through the windows.

The present disclosure includes embodiments of a system for blending cement and at least one additive during a blending job to create a cement slurry for use in an underground hydrocarbon well. The system includes a mixing tub having an upper end and a lower end and at least one outer wall extending therebetween, at least one inflow port formed in the outer wall and configured to allow the flow of at least one among cement and at least one additive into the mixing tub to be used to create the cement slurry, and at least one discharge port formed in the mixing tub and configured to allow the discharge of cement slurry from the mixing tub. At least first and second adjacent blenders are associated with the mixing tub, each having at least a first elongated, rotatable, mixing blade extending into the mixing tub. The first mixing blade of the first blender is configured to rotate in a direction opposite to the rotational direction of the first mixing blade of the second blender.

In these embodiments, at least one inner discharge tube and at least one outer discharge tube are disposed within the mixing tub. The inner discharge tube is positioned concentrically within the outer discharge tube. The inner and outer discharge tubes have respective open upper and lower ends. The respective upper ends of the discharge tubes are positioned in the mixing tub closest to the upper end of the mixing tub and the respective lower ends of the discharge tubes are positioned in the mixing tub closest to the lower end thereof. The inner discharge tube is in fluid communication with at least one discharge port of the mixing tub. The discharge tubes are configured to allow cement slurry to flow from the mixing tub into the upper end of the inner discharge tube, through the inner discharge tube and out the mixing tub through the at least one discharge port therein. Each discharge tube has a wall extending between the upper and lower ends thereof and at least one window formed in the wall. At least one window of the outer discharge tube is alignable over at least one window of the inner discharge tube. At least one among the inner and outer discharge tubes is selectively movable relative to the other discharge tube to move the respective alignable windows thereof between at least one aligned position and at least one misaligned position. The windows in the aligned position allow the flow of cement slurry therethrough from the mixing tub into the inner discharge tube. The windows in the misaligned position disallow the flow of cement slurry through the windows.

The present disclosure also includes embodiments of a system for blending cement and at least one additive during a blending job to create a cement slurry. The system includes a mixing tub having an upper end and a lower end and at least one outer wall extending therebetween, at least one inflow port formed in the outer wall configured to allow the flow of at least one among cement and at least one additive into the mixing tub to be used to create the cement slurry, and at least one discharge port formed in the mixing tub and configured to allow the discharge of cement slurry from the mixing tub. At least first and second adjacent blenders are associated with the mixing tub. Each blender has at least a first elongated, rotatable, mixing blade extending into the mixing tub. The first mixing blade of the first blender is configured to rotate in a direction opposite to the rotational direction of the first mixing blade of the second blender. The blenders are configured to mix the cement and at least one additive to form the cement slurry within the mixing tub.

In these embodiments, at least one inner discharge tube and at least one outer discharge tube are disposed within the mixing tub. The inner discharge tube is positioned concentrically within the outer discharge tube. The inner and outer discharge tubes have respective upper and lower ends and are configured to allow cement slurry to flow from the mixing tub into the upper end of the inner discharge tube, through the inner discharge tube, out of the lower end of the inner discharge tube and out of the mixing tub through at least one discharge port. Each discharge tube has a wall extending between the upper and lower ends thereof and at least one window formed in the wall. At least one window of the outer discharge tube is alignable over at least one window of the inner discharge tube. At least one among the inner and outer discharge tubes is selectively rotatable relative to the other discharge tube to move the respective alignable windows thereof between at least one aligned position and at least one misaligned position. The windows in the aligned position allow the flow of cement slurry therethrough from the mixing tub into the inner discharge tube. The windows in the misaligned position disallowing the flow of cement slurry through the windows.

Accordingly, the present disclosure includes features and advantages which are believed to enable it to advance cement blending technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
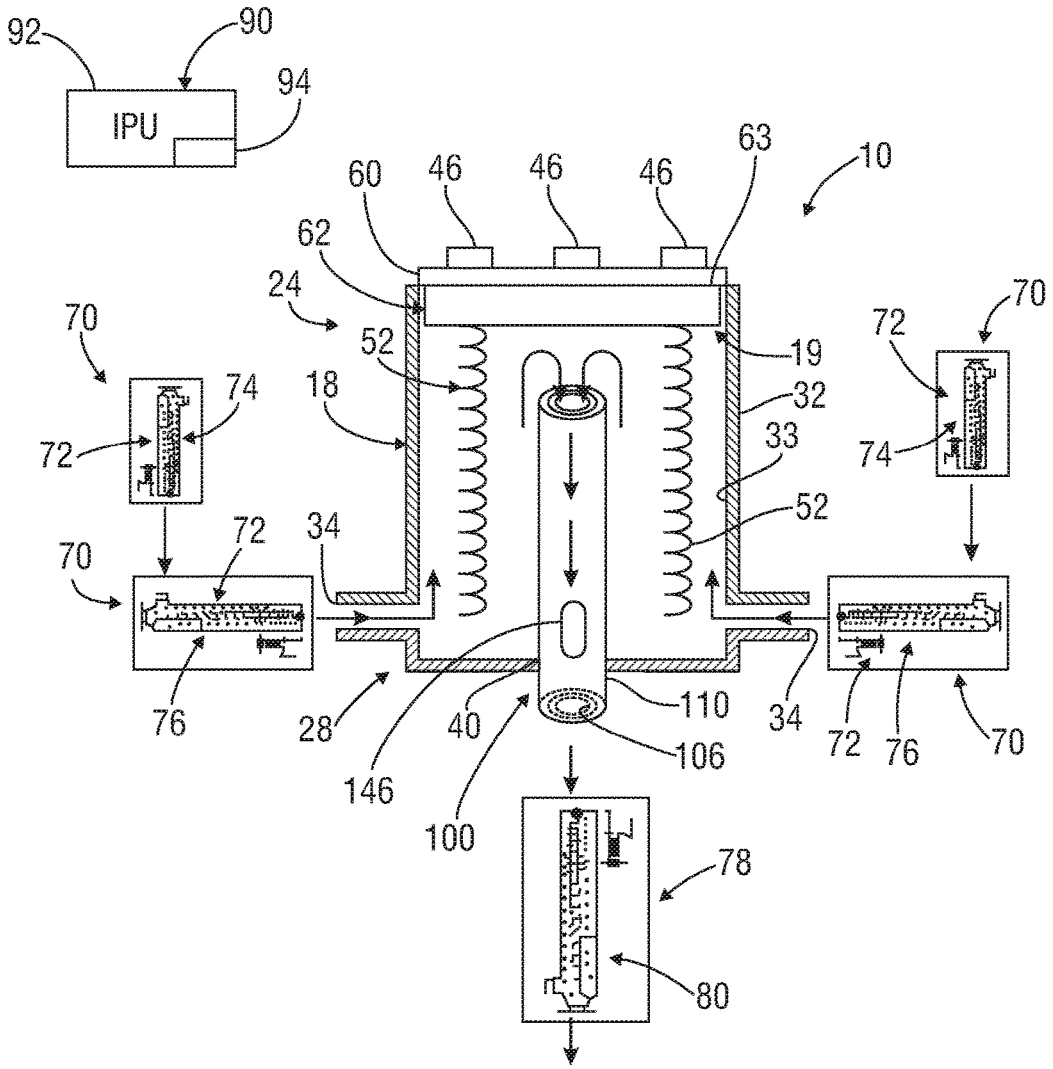
FIG. 1 is a partial cross-sectional view of an embodiment of a cement blending system in accordance with the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and described preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring to FIG. 1, in accordance with an embodiment of the present disclosure, a cement blender, or blending system, 10 useful for blending cement and at least one additive is shown. The system 10 may be useful during a blending job to create a desired quantity of cement slurry for forming cement in any desired application. For example, the cement slurry may be delivered to an underground hydrocarbon well, such as for use in affixing the casing in the well or any other desired purpose.

The illustrated system 10 includes a mixing tub 18 having any suitable form, configuration and operation. In this example, the tub 18 is a cylindrical tank, has an upper end 24 and a lower end 28 and at least one outer wall 32 extending therebetween. The tub 18 will hold the cement and additives during blending. The upper end 24 is at least partially open and the lower end 28 is at least substantially closed. As used herein, the term "substantially" means completely or nearly completely. For example, a lower end 28 of a mixing tub 18 having one or more discharge ports 40 (as will be described further below) formed therein or proximate to is "substantially" closed.

The exemplary tub 18 includes at least two inflow ports 34 and at least one discharge port 40. The inflow and discharge ports 34, 40 may have any suitable size, configuration, form and operation. In this example, four inflow ports 34 are formed in the outer wall 32 of the tub 18, such as proximate to, and spaced apart around, the lower end 28 of the tub 18. As used herein, the term "proximate to" means at or near the referenced component feature, or closer to the referenced component feature than the opposing feature of the component. For example, "proximate to" the lower end 28 of the tub 18 means at or near the lower end 28 or closer to the lower end 28 than the upper end 24 of the tub 18.

Each exemplary inflow port 34 is configured to allow the flow of a desired cement slurry component (e.g. cement and/or at least one additive) into the mixing tub 18. In this embodiment, a single discharge port 40 is formed in the illustrated mixing tub 18 proximate to the lower end 28 thereof, such as to allow the discharge of cement slurry therefrom.

Still referring to the embodiment of FIG. 1, the system 10 also includes multiple adjacent blenders 46 disposed upon a platform 60. The blenders 46 are configured to mix the cement and at least one additive to form the cement slurry. The blenders 46 and platform 60 may have any suitable form, configuration and operation. In this embodiment, the platform 60 is configured to rest atop the open upper end 24 of the mixing tub 18 and is removable therefrom, such as for maintenance or replacement of the platform 60, blenders 46 or other components, or any other desired purpose. In other embodiments, the platform 60 may be selectively movable within or relative to the mixing tub 18, such as with the use of one or more hydraulic drivers to vary the position of the blenders 46, or for any other desired purpose.

If desired, one or more scrapers 62 may extend from the platform 60 at least partially into the tub 18, such as to assist in moving the cement slurry around in the tub 18 and/or preventing the cement slurry from sticking to the interior side 33 of the wall 32 of the tub 18. The scraper 62 may have any suitable form, configuration and operation. For example, the scraper 62 may include a pair of plates (e.g. metal plates) 63 extending downwardly from the bottom of the platform 60 into an upper portion 19 of the tub 18. If desired, the plates 63 may extend down into the tub 18 to be near the top of a cement slurry collection system 100 (which will be described below). In this embodiment, the exemplary plates 63 are disposed in an X-type configuration relative to one another and positioned so that their respective outer edges abut or closely align with the interior side 33 of the tub wall 32 as the platform 60 rotates relative thereto.

Still referring to FIG. 1, any desired number of blenders 46 may be used. For example, two, three or four blenders 46 may be included. The illustrated embodiment includes four blenders 46 arranged in a circular configuration on the platform 60. Likewise, any desired type of blender 46 may be used. For example, the blenders 46 may be ribbon blenders as are and become further know. Each exemplary blender 46 includes at least one elongated mixing blade 52 extending into the mixing tub 18 and configured to rotate in a direction opposite to the rotational direction of the blade(s) 52 of the blender(s) 46 that are adjacent to it. In this embodiment, each exemplary blender 46 includes a single mixing blade 52 that extends into the tub 18 below the platform 60 to a desired height in the tub 18. For example, the blades 52 may extend down to a position near the bottom of the tub 18, such as to a height of approximately 2 inches above the lower end 28 of the tub 18.

As stated, each blade 52 of each illustrated blender 46 is rotatable in a direction opposite to the rotational direction of the mixing blade(s) 52 of each adjacent blender 46. For example, the blades 52 of the first and third blenders 46*a*, 46*c* may be rotatable in the clockwise direction, while the blades 52 of the second and fourth blenders 46*b*, 46*d* are rotatable in the counterclockwise direction.

The exemplary platform 60 is shown positioned proximate to the upper end 24 of the tub 18 and is itself rotatable relative thereto, so that the blenders 46 and their mixing blades 52 are concurrently rotatable within the mixing tub 18. Thus, in this example, the platform 60 provides for the "planetary" rotation of the blenders 46 and their blades 52 in the tub 18.

Figure 2:
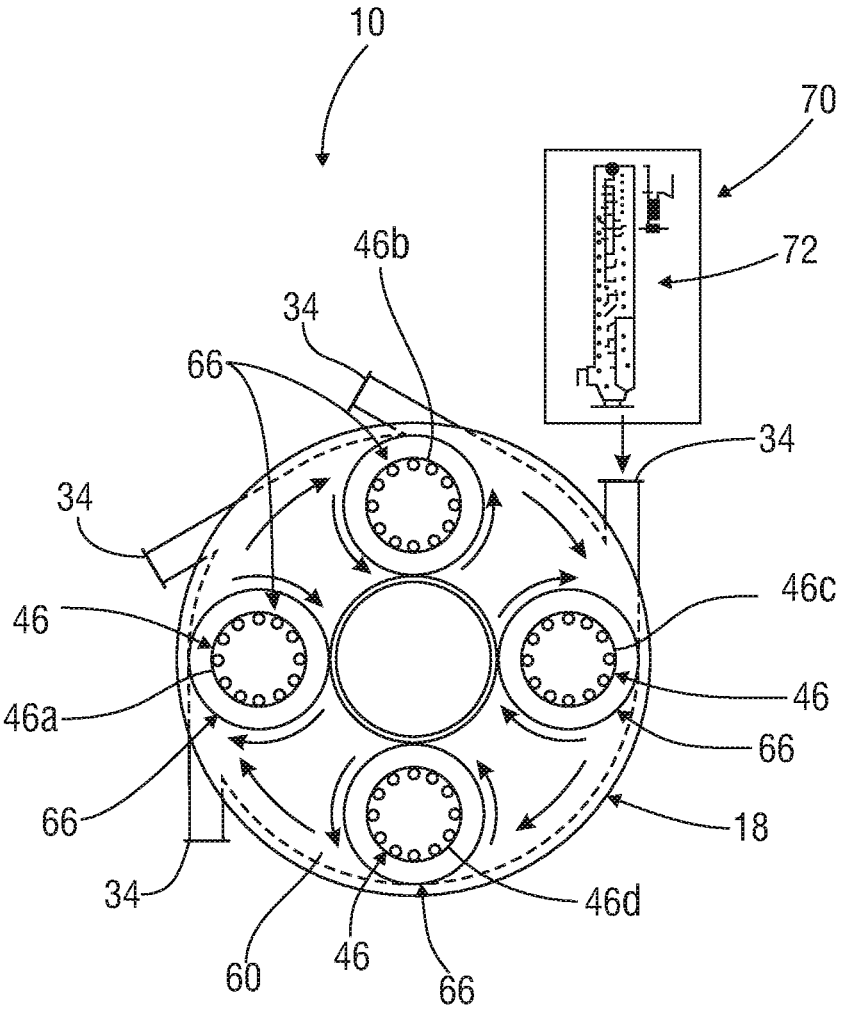
FIG. 2 is a top view of the exemplary cement blending system shown in FIG. 1.

The blenders 46 may be powered in any suitable manner. For example, as shown in FIG. 2, any desirable number, type and configuration of electric motors 66 may be used to power the blenders 46. In this embodiment, a distinct electric motor 66 is electrically coupled to each respective blender 46 to rotate the mixing blade(s) 52 thereof. Each illustrated motor 66 is electrically and mechanically coupled to its respective blender 46, forming a unitary component disposed upon the platform 60. In other embodiments, a single electric motor 66 may be configured to provide power to all of the blenders 46, such as with the use of gear mechanisms (not shown).

Likewise, the platform 60 may be powered in any suitable manner. For example, a distinct electric motor may be electrically coupled to the platform 60 to rotate it. If desired, one of the motors 66 used to power one or more of the blenders 46 may be used to power the platform 60. For example, if a single electric motor provides power to all of the blenders 46, such motor 66 may also be used to power the platform 60, such as with the use of gear mechanisms (not shown). If desired, the speed of rotation of the mixing blades 52 and/or platform 60 may be selectively variable. For example, the motor(s) 66 may be variable speed. However, the blenders 46 and platform 60 may be powered with any other suitable power supply.

Referring back to FIG. 1, the cement and additive(s) may be provided to the inflow ports 34 of the tub 18 in any suitable manner. In this embodiment, at least one distinct, selectively operable, material inflow conveyor 70 is associated with each inflow port 34 and configured to provide a flow of one or more desired cement slurry components (e.g. cement, additive, etc.) into the mixing tub 18 as desired during, or throughout, the blending job. If desired, multiple conveyors 70 may be associated with a single inflow port 34. Different conveyors 70 may have different capacities. For example, one or more small capacity conveyors 74 may feed one or more additives to a large capacity conveyor 76, which feeds the slurry component to a particular inflow port 34.

If desired, each material inflow conveyor 70 may be configured to be selectively controlled to provide a continuous, or varied, flow of the desired cement slurry component(s) into the tub 18 through its associated inflow port 34. For example, an information processing unit (IPU) 90, such as a general purpose computer 92, may communicate with each conveyor 70, such as through cables or wireless communication. The IPU 90 may include one or more computer-readable media, such as computer software 94, programmable to selectively vary or control the speed of the conveyor 70, or rate of delivery of the subject cement slurry component(s) via the conveyor 70, during the blending job. For example, the speed of the conveyor(s) 70 providing cement, such as Portland cement, to the mixing tub 18 may be determined based upon the weight of the cement. For another example, the speed of the conveyor(s) 70 providing additives may be based upon the speed of the conveyor(s) 70 providing the cement.

In some blending jobs, highly concentrated additives by weight of cement, such as, for example, silica flour, silica sand, hematite, fly ash and/or glass beads, may be continuously fed through one or more inflow ports 34. Low concentration additives by weight of cement, such as, for example, fluid loss control additives, retarders, suspending agents and dispersants, may be fed by one or more small capacity conveyors 74. When multiple conveyors 70 provide one or more cement slurry components to the same inflow port 34, each such conveyor 70 may be selectively controlled by the IPU 90 to provide the desired amount or mixture of delivered cement slurry component(s).

The material inflow conveyors 70 may have any suitable form, configuration and operation. The illustrated material inflow conveyor 70 is a conventional screw conveyor 72. In other embodiments, the material inflow conveyor 70 may, for example, include a conveyor belt.

Still referring to FIG. 1, if desired, one or more material discharge conveyors 78 may be associated with the discharge port(s) 40 of the mixing tub 18, such as to receive the blended cement slurry discharged from the mixing tub 18 and deliver it to at least one other location. In some embodiments, for example the discharge conveyor 78 may move the blended cement slurry to one or more bulk trucks. The illustrated material discharge conveyor 78 is configured to be selectively controlled to vary the flow of blended cement slurry from the mixing tub 18 to one or more trucks or trailer-mounted tanks.

The material discharge conveyor(s) 78 may have any suitable form, configuration and operation. For example, the capacity of the discharge conveyor 78 may be between approximately two to three times greater than the capacity of each inflow conveyor 70 which supplies cement to the mixing tub 18, such as to assist in preventing the system 10 from choking down during a blending job. The illustrated material discharge conveyor 78 is a conventional screw conveyor 80. In other embodiments, the material discharge conveyor 78 may, for example, include a conveyor belt.

Figure 3:
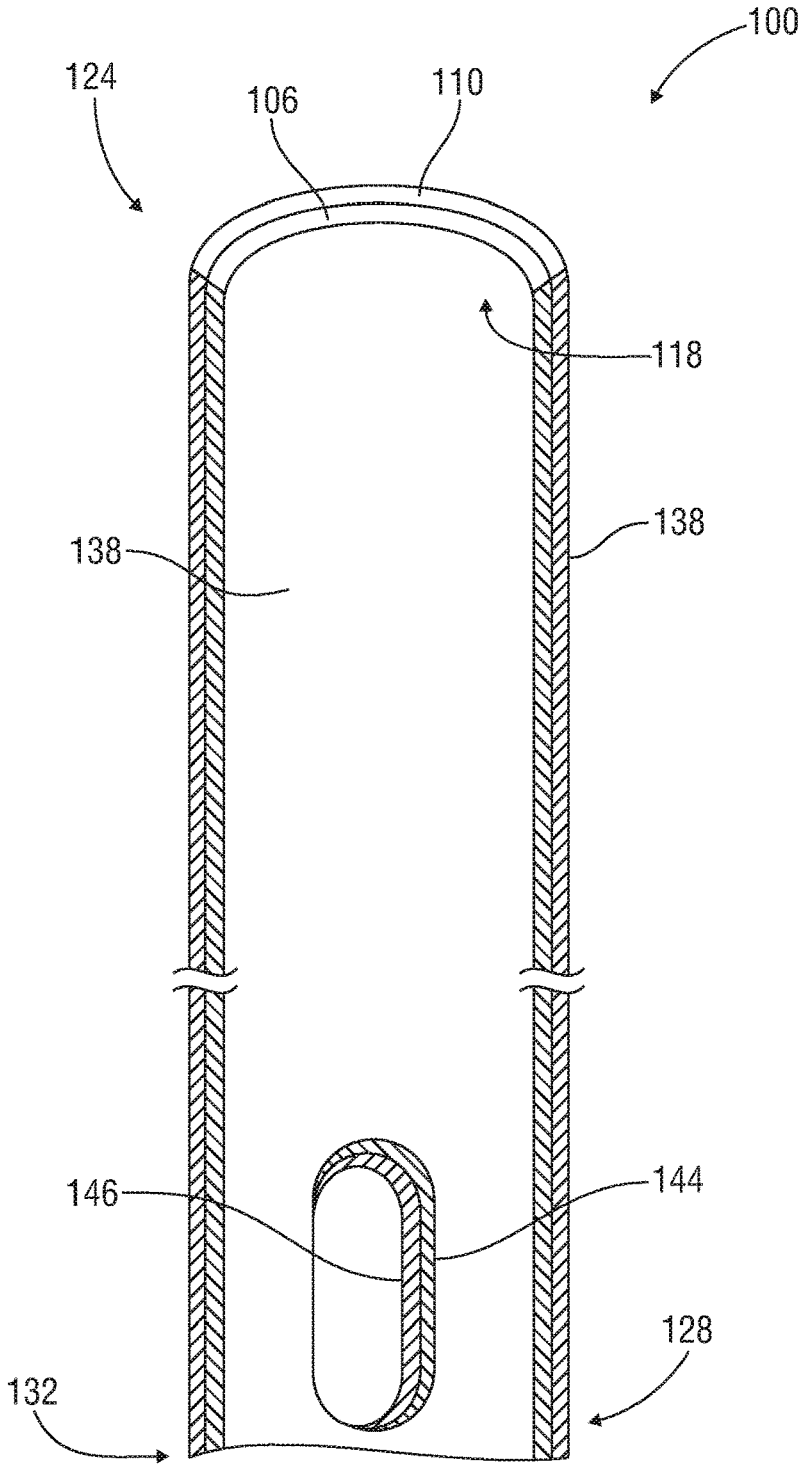
FIG. 3 is a cross-sectional view of an embodiment of an internal cement slurry collection system used in the exemplary cement blending system shown in FIG. 1.

Referring now to FIGS. 1 & 3, in an independent aspect of the disclosure, an internal cement slurry collection system 100 is shown. The exemplary system 100 includes at least one inner discharge tube 106 and at least one outer discharge tube 110 disposed within the mixing tub 18. The tubes 106, 110 may have any suitable form, configuration and operation. In this example, the inner discharge tube 106 is positioned concentrically within the outer discharge tube 110, so that the respective open upper ends 118, 124 and lower ends 128, 132 of the tubes 106, 110 are adjacent.

For each exemplary tube 106, 110, a wall 138 extends between its respective ends. The illustrated tubes 106, 110 are shown vertically oriented in the center of the mixing tub 18 so that their upper ends 118, 124 are positioned in the mixing tub 18 closest to the upper end 24 thereof, while their lower ends 128, 132 are positioned closest to the lower end 28 of the mixing tub 18. If desired, the upper ends 118, 124 of the tubes 106, 110 may be selectively positioned at a desired height in the tub 18 to ensure the blended mixture will enter the tube 106 before overflowing out of the top (upper end 24) of the tub 18. In this example, the upper ends 118, 124 of the tubes 106, 110 are disposed at a height below the upper end 24 of the mixing tub 18. For example, the upper ends 118, 124 may be positioned down from the upper end 24 of the tub 18 a distance equal to between approximately 20%-40% of the overall height of the tub 18. However, in other embodiments, the tubes 106, 110 may be angularly oriented or otherwise not vertically oriented and at any desired location in the tub 18. Likewise, if desired, the upper ends 118, 124 of the tubes 106, 110 may be aligned with or above the upper end 24 of the tub 18.

The discharge tubes 106, 110 may be sized as desired. For example, the inner diameter of the inner discharge tube 106 may be between approximately two and approximately three times greater than the inner diameter of each inflow port 34 of the tub 18. The exemplary inner discharge tube 106 fluidly communicates with at least one discharge port 40 of the tub 18. In this embodiment, the tubes 106, 110 allow blended cement slurry to flow from the mixing tub 18 into the upper end 118 of the inner discharge tube 106, through the inner discharge tube 106 and out lower end 128 thereof and out the mixing tub 18 through the discharge port(s) 40 therein.

Still referring to FIGS. 1 & 3, each exemplary discharge tube 106, 110 includes at least one window 144, 146, respectively, formed in the wall 138 thereof proximate to the lower end thereof 128, 132, respectively. The illustrated tubes 106, 110 are arranged so that at least one window 146 of the outer discharge tube 110 is alignable over at least one window 144 of the inner discharge tube 106. In this embodiment, at least one among the inner and outer discharge tubes 106, 110 is selectively movable relative to the other tube to move at least one of the respective windows 144, 146 of the tubes 106, 110 between at least one aligned position and at least one misaligned position. For example, the lower end 128 of the inner discharge tube 106 may be rigidly mounted (e.g. welded) to the mixing tub 18 and the outer discharge tube 110 rotatable around the inner discharge tube 106, or vice versa.

In this embodiment, the respective windows 144, 146 of the inner and outer discharge tubes 106, 110 are normally maintained in the misaligned position during the blending job. In the misaligned position, the illustrated respective windows 144,146 disallow the flow of cement slurry therethrough. In the aligned position, the respective windows 144, 146 allow the flow of cement slurry therethrough from the mixing tub 18 into the inner discharge tube 106. For example, the respective windows 144, 146 may be placed in the aligned position to allow the discharge of cement slurry remaining in the mixing tub 18 when the height of the cement slurry in the tub 18 falls below the height of the upper ends 118, 124 of the tubes 106, 110, such as at or near the end of a blending job. In some applications, for example, a significant quantity, such as approximately 10 cubic feet, of cement slurry may remain in the tub 18 below the height of the upper ends 118, 124 tubes 106, 110 near the end of the blending job. For another example, the windows 144, 146 may be aligned to allow cleaning of the tub 18, such as before starting another blending job.

Referring back to FIG. 1, in an example cement slurry blending job using the illustrated embodiment of the cement blending system 10 and slurry collection system 100, the desired cement and additives may be continuously fed at desired rates from the inflow conveyors 70 into the tub 18 through the inflow ports 34 to allow uniform mixing and provide a desired blended product. In a computer-implemented process, the controller 90 may be programmed to control and provide the desired proportional amounts and flow rates of cement and additives via the conveyors 70 into the tub 18 on a dynamic, real-time basis, throughout the blending job. Thus, without the use of injected air, the precise desired proportions of cement and additives are continuously fed into the mixing tub 18, blended immediately when introduced and continuously thereafter until discharged from the tub 18. The exemplary process provides greater accuracy of blending ratios and more reliable blending, resulting in a more uniformly blended product. The resulting blended cement slurry product may more accurately achieve the desired blending ratio and cement attributes, leading to improved cement performance.

In this embodiment, the cement slurry components are agitated and blended together in the mixing tub 18 to form a uniformly blended slurry output. In this example, the individual and planetary rotation of the exemplary blender blades 52 stirs and agitates the cement and additives in the mixing tub 18. For example, the rotation of the blades 52 may move the cement and additives up, down and sideways in, and around, the mixing tub 18. Referring to FIG. 2, in this embodiment, the blades 52 of the first and third blenders 46*a*, 46*c* may pick up cement/additives fed into the tub 18 at the inflow ports 34 and move it upwards in, around and towards the outer wall 32 of, the tub 18, while the blades 52 of the second and fourth blenders 46*b*, 46*d* push the mixture downwardly, around and inwardly in the tub 18. At the same time, the planetary rotation of the exemplary blenders 46 will concurrently move all the blades 52 in a horizontal plane in the tub 18, pushing the mixture around the tub 18 before it flows into the cement slurry collection system 100. The continuous stirring, agitation and movement of the slurry components up, sideways and around the mixing tub may reduce material segregation of the components due to their differing specific gravities, leading to a uniformly blended product. The orientation, rotation and variable speed (if included) of the exemplary mixing blades 52 and platform 60 provide efficient, even blending.

The present embodiment requires neither stopping the blending operation to load slurry components and unload (or box) the blended slurry product, nor the material handling personnel required for air-bulk blending. In addition, the size of the blending tub does not limit the size of each blending job, which can be continuous and provide any desire slurry product capacity. Also, there is less, or no, loss of low-specific gravity components as compared to air-bulk blending. Using the exemplary methodology and/or equipment may avoid potential safety issues that could arise during air-bulk blending, such as with use of high pressure air equipment and the generation of dust in the ambient air. In many applications, the mixing tub may be completely or nearly completely emptied, helping reduce or prevent material contamination between jobs. The cement and additives may experience less air moisture contamination and premature chemical reaction during blending, leading to better performance of the cement slurry product. The blended slurry product may have less tendency to adhere to the tank wall, making transfer out of the mixing tub easier. Inspection, cleaning and maintenance of the mixing tub and related equipment may be easier. The present embodiment may provide for reduced manpower and labor costs due to less human handling of materials, and/or reduced costs associated with operations and maintenance of equipment, spillage and other factors.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. System for blending cement and at least one additive during a blending job to create a cement slurry for use in an underground hydrocarbon well, the system comprising:

a mixing tub having an upper end and a lower end and at least one outer wall extending therebetween, said upper end being at least partially open and said lower end being at least substantially closed, at least two inflow ports formed in said outer wall, each said inflow port being configured to allow the flow of at least one among cement and at least one additive into said mixing tub to be used to create the cement slurry, and at least one discharge port formed in said mixing tub and configured to allow the discharge of cement slurry from said mixing tub;

at least first and second adjacent blenders associated with said mixing tub, each said blender having at least a first elongated, rotatable, mixing blade extending into said mixing tub, said first mixing blade of said first blender being configured to rotate in a direction opposite to the rotational direction of said first mixing blade of said second blender, said blenders being configured to mix the cement and at least one additive to form the cement slurry within said mixing tub; and a platform upon which said blenders are mounted and below which said mixing blades extend, said platform being configured to be positioned proximate to said upper end of said mixing tub and rotatable relative to said mixing tub, where by rotation of said platform concurrently rotates said blenders mounted thereto.

2. The system of claim 1 further including at least third and fourth adjacent said blenders associated with said mixing tub and mounted upon said platform adjacent to said first and second blenders in a circular configuration, each of said third and fourth blenders having at least a first elongated, rotating, mixing blade extending into said mixing tub below said platform, wherein said first mixing blade of each of said first, second, third and fourth blenders rotates in a direction opposite to the rotational direction of said first mixing blade of each respective said blender that is adjacent thereto.

3. The system of claim 1 further including an electric motor electrically coupled to all said blenders and carried by said platform, said electric motor being configured to provide power to each said blender to rotate each said respective mixing blade thereof.

4. The system of claim 1 further including first and second electric motors electrically coupled to said first and second blenders, respectively, each said electric motor being configured to provide power to its respective corresponding said blender to rotate said at least one mixing blade thereof.

5. The system of claim 1 further including at least one distinct material inflow conveyor associated with each said inflow port and configured to deliver a continuous flow of at least one among cement and at least one additive into said mixing tub throughout the blending job.

6. The system of claim 5 wherein each said material inflow conveyor is configured to be selectively controllable to vary the flow of at least one among cement and at least one additive delivered into said mixing tub through its associated inflow port.

7. The system of claim 5 wherein said material inflow conveyor is a screw conveyor.

8. The system of claim 1 further including at least one material discharge conveyor associated with said at least one discharge port of said mixing tub, said material discharge conveyor being configured to receive the cement slurry discharged from said mixing tub and deliver it to at least one other location.

9. The system of claim 8, wherein said at least one material discharge conveyor is configured to be selectively controllable to vary the flow of cement slurry from said mixing tube to the at least one other location.

10. The system of claim 8 further including at least one distinct material inflow conveyor associated with each said inflow port and configured to deliver a continuous flow of at least one among cement and at least one additive into said mixing tub during the blending job, wherein said material discharge conveyor has a capacity to deliver cement slurry from said mixing tub that is between two and three times greater than the capacity of each said material inflow conveyor used to deliver cement to said mixing tub.

11. The system of claim 1 wherein said platform is configured to rest atop said upper end of said mixing tub.

12. The system of claim 1 further comprising at least one inner discharge tube and at least one outer discharge tube disposed within said mixing tub, said inner discharge tube being positioned concentrically within said outer discharge tube, said inner and outer discharge tubes having respective open upper and lower ends, said respective upper ends of said discharge tubes being positioned in said mixing tub closer to said upper end of said mixing tub than said lower ends of said discharge tubes and said respective lower ends of said discharge tubes being positioned in said mixing tub closer to said lower end of said mixing tub than said upper ends of said discharge tubes, said inner discharge tube being in fluid communication with at least one said discharge port of said mixing tub, wherein said discharge tubes are configured to allow cement slurry to flow from said mixing tub into said upper end of said inner discharge tube, through said inner discharge tube and out said mixing tub through at least one said discharge port therein, each said discharge tube having a wall extending between said upper and lower ends thereof and at least one window formed in said wall of said each discharge tube, at least one said window of said outer discharge tube being alignable over at least one said window of said inner discharge tube, at least one among said inner and outer discharge tubes being selectively rotatable relative to said other discharge tube to move said respective alignable windows thereof between at least one aligned position and at least one misaligned position, said windows in said aligned position allowing the flow of cement slurry therethrough from said mixing tub into said inner discharge tube, and said windows in said misaligned position disallowing the flow of cement slurry through said windows.

13. The system of claim 12 wherein said upper ends of said inner and outer discharge tubes are positioned at distance below said upper end of said mixing tub equal to between 20%-40% the overall height of said mixing tub.

14. The system of claim 12 wherein said discharge tubes are vertically oriented in said mixing tub.

15. The system of claim 12 wherein said respective alignable windows of said inner and outer discharge tubes are configured to be movable into said aligned position to allow the discharge of cement slurry remaining in said mixing tub when the height of the cement slurry in said mixing tub falls below the height of said upper ends of said inner and outer discharge tubes.

16. The system of claim 12 wherein said respective alignable windows of said inner and outer discharge tubes are configured to be maintained in said misaligned position during the blending job.

17. The system of claim 12 wherein said inner discharge tube is selectively rotatable relative to said outer discharge tube to change the position of said respective alignable windows thereof between said aligned and said misaligned positions.

18. The system of claim 12 wherein the inner diameter of said inner discharge tube is between two and three times greater than the inner diameter of each said inflow port of said mixing tub.

19. The system of claim 1 further including at least one scraper extending downwardly from said platform at least partially into said mixing tub and configured to assist in moving the cement slurry around in said mixing tub.

20. The system of claim 1 wherein said outer wall of said mixing tub includes an interior side, further including at least one scraper extending downwardly from said platform at least partially into said mixing tub and configured to assist in preventing the cement slurry from sticking to the interior side of said outer wall of said mixing tub.

21. A system for blending cement and at least one additive during a blending job to create a cement slurry for use in an underground hydrocarbon well, the system comprising:

a mixing tub having an upper end and a lower end and at least one outer wall extending therebetween, at least one inflow port formed in said outer wall and configured to allow the flow of at least one among cement and at least one additive into said mixing tub to be used to create the cement slurry, and at least one discharge port formed in said mixing tub and configured to allow the discharge of cement slurry from said mixing tub;

at least first and second adjacent blenders associated with said mixing tub, each said blender having at least a first elongated, rotatable, mixing blade extending into said mixing tub, said first mixing blade of said first blender being configured to rotate in a direction opposite to the rotational direction of said first mixing blade of said second blender; and at least one inner discharge tube and at least one outer discharge tube disposed within said mixing tub, said inner discharge tube being positioned concentrically within said outer discharge tube, said inner and outer discharge tubes having respective open upper and lower ends, said respective upper ends of said discharge tubes being positioned in said mixing tub closest to said upper end of said mixing tub and said respective lower ends of said discharge tubes being positioned in said mixing tub closest to said lower end thereof, said inner discharge tube being in fluid communication with at least one said discharge port of said mixing tub, wherein said discharge tubes are configured to allow cement slurry to flow from said mixing tub into said upper end of said inner discharge tube, through said inner discharge tube and out said mixing tub through said at least one discharge port therein, each said discharge tube having a wall extending between said upper and lower ends thereof and at least one window formed in said wall of each said discharge tube, at least one said window of said outer discharge tube being alignable over at least one said window of said inner discharge tube, at least one among said inner and outer discharge tubes being selectively movable relative to said other discharge tube to move said respective alignable windows thereof between at least one aligned position and at least one misaligned position, said windows in said aligned position allowing the flow of cement slurry therethrough from said mixing tub into said inner discharge tube, and said windows in said misaligned position disallowing the flow of cement slurry through said windows.

22. The system of claim 21 wherein said upper ends of said inner and outer discharge tubes are disposed at a height in said mixing tub below said upper end of said mixing tub.

23. The system of claim 21 wherein said respective alignable windows of said inner and outer discharge tubes are configured to be movable into said aligned position to allow the discharge of cement slurry remaining in said mixing tub when the height of the cement slurry in said mixing tub falls below the height of said upper ends of said inner and outer discharge tubes.

24. The system of claim 21 wherein said respective alignable windows of said inner and outer discharge tubes are configured to be movable into said aligned position at or near the end of the blending job.

25. The system of claim 1 wherein said at least two inflow ports and said at least one discharge port are formed in said mixing tub proximate to said lower end of said mixing tub.

26. System for blending cement and at least one additive during a blending job to create a cement slurry, the system comprising:

a mixing tub having an upper end and a lower end and at least one outer wall extending therebetween, at least one inflow port formed in said outer wall configured to allow the flow of at least one among cement and at least one additive into said mixing tub to be used to create the cement slurry, and at least one discharge port formed in said mixing tub and configured to allow the discharge of cement slurry from said mixing tub;

at least first and second adjacent blenders associated with said mixing tub, each said blender having at least a first elongated, rotatable, mixing blade extending into said mixing tub, said first mixing blade of said first blender being configured to rotate in a direction opposite to the rotational direction of said first mixing blade of said second blender, said blenders being configured to mix the cement and at least one additive to form the cement slurry within said mixing tub; and at least one inner discharge tube and at least one outer discharge tube disposed within said mixing tub, said inner discharge tube being positioned concentrically within said outer discharge tube, said inner and outer discharge tubes having respective upper and lower ends, said discharge tubes being configured to allow cement slurry to flow from said mixing tub into said upper end of said inner discharge tube, through said inner discharge tube, out of said lower end of said inner discharge tube and out of said mixing tub through at least one said discharge port, each said discharge tube having a wall extending between said upper and lower ends thereof and at least one window formed in said wall of each said discharge tube, at least one said window of said outer discharge tube being alignable over at least one said window of said inner discharge tube, at least one among said inner and outer discharge tubes being selectively rotatable relative to said other discharge tube to move said respective alignable windows thereof between at least one aligned position and at least one misaligned position, said windows in said aligned position allowing the flow of cement slurry therethrough from said mixing tub into said inner discharge tube, and said windows in said misaligned position disallowing the flow of cement slurry through said windows.

27. The system of claim 26 wherein said alignable windows of said inner and outer discharge tubes are disposed proximate to said respective lower ends of said inner and outer discharge tubes.

28. The system of claim 27 wherein said upper and lower ends of said inner and outer discharge tubes are open, said respective upper ends of said inner and outer discharge tubes are adjacent to one another and said respective lower ends of said inner and outer discharge tubes are adjacent to one another.

29. The system of claim 26 further including a platform upon which said blenders are mounted and below which said mixing blades extend, said platform being configured to be positioned proximate to said upper end of said mixing tub and rotatable relative thereto, whereby rotation of said platform concurrently rotates said blenders mounted thereto.

30. The system of claim 26 wherein said outer wall of said mixing tub includes an interior side, further including at least one scraper extending downwardly at least partially into said mixing tub and configured to assist in preventing the cement slurry from sticking to said interior side of said outer wall of said mixing tub.

* * * * *